US009174211B2

(12) United States Patent
Jones et al.

(10) Patent No.: US 9,174,211 B2
(45) Date of Patent: Nov. 3, 2015

(54) MICROSTRUCTURED MICROPILLAR ARRAYS FOR CONTROLLABLE FILLING OF A CAPILLARY PUMP

(71) Applicant: IMEC VZW, Leuven (BE)

(72) Inventors: Benjamin Jones, Leuven (BE); Paolo Fiorini, Brussels (BE)

(73) Assignee: IMEC VZW, Leuven (BE)

( * ) Notice: Subject to any disclaimer, the term of this patent is extended or adjusted under 35 U.S.C. 154(b) by 0 days.

(21) Appl. No.: 14/597,716

(22) Filed: Jan. 15, 2015

(65) Prior Publication Data

US 2015/0196909 A1 Jul. 16, 2015

(30) Foreign Application Priority Data

Jan. 15, 2014 (EP) ..... 14151290

(51) Int. Cl.
*F15C 1/02* (2006.01)
*B01L 3/00* (2006.01)

(52) U.S. Cl.
CPC ..... *B01L 3/50273* (2013.01); *B01L 3/502738* (2013.01); *B01L 3/502746* (2013.01); *B01L 2300/0838* (2013.01); *B01L 2300/12* (2013.01); *B01L 2400/0406* (2013.01); *B01L 2400/0688* (2013.01)

(58) Field of Classification Search
CPC ..... B01L 3/50273; B01L 3/502738; B01L 3/502746; B01L 2400/0406; B01L 2400/0688; B01L 2300/12; B01L 2300/0838; Y10T 137/213; Y10T 137/2224; Y10T 137/206; Y10T 137/85978; Y10T 137/8593
USPC ..... 137/803, 825, 833, 561 A, 565.01, 137/565.37; 422/502, 505, 507; 156/247
See application file for complete search history.

(56) References Cited

U.S. PATENT DOCUMENTS

| | | | | |
|---|---|---|---|---|
| 5,230,866 | A * | 7/1993 | Shartle et al. | 422/68.1 |
| 6,454,924 | B2 * | 9/2002 | Jedrzejewski et al. | 204/601 |
| 6,601,613 | B2 * | 8/2003 | McNeely et al. | 137/833 |
| 6,615,856 | B2 * | 9/2003 | McNeely et al. | 137/14 |
| 7,412,990 | B2 * | 8/2008 | Chung et al. | 137/833 |

(Continued)

FOREIGN PATENT DOCUMENTS

WO 2013/029159 A1 3/2013

OTHER PUBLICATIONS

Extended European Search Report, European Patent Application No. 14151290.5, dated Jun. 17, 2014.

(Continued)

*Primary Examiner* — John K Fristoe, Jr.
*Assistant Examiner* — Minh Le
(74) *Attorney, Agent, or Firm* — McDonnell Boehnen Hulbert & Berghoff LLP

(57) ABSTRACT

The embodiments of the present disclosure relate to a micro-fluidic device comprising a substrate, a cavity in the substrate and a plurality of micro-pillar columns located inside the cavity. The micro-pillars columns are configured to create a capillary action when a fluid sample is provided in the cavity. A micro-fluidic channel is present between two 5 walls of any two adjacent micro-pillars in a same micro-pillar column. Each of the two walls comprises a sharp corner along the direction of a propagation path of the fluid sample in the micro-fluidic channel thereby forming a capillary stop valve. A notch provided in a sidewall of the cavity acts as a capillary stop valve.

8 Claims, 6 Drawing Sheets

(56) References Cited

U.S. PATENT DOCUMENTS

| | | | | |
|---|---|---|---|---|
| 7,681,595 | B2 * | 3/2010 | Kim et al. | 137/825 |
| 8,122,909 | B2 * | 2/2012 | Tonkovich et al. | 137/833 |
| 8,215,338 | B2 * | 7/2012 | Delattre et al. | 137/599.06 |
| 8,398,936 | B2 * | 3/2013 | Horiuchi et al. | 422/504 |
| 8,398,937 | B2 * | 3/2013 | Kitamura et al. | 422/504 |
| 8,765,454 | B2 * | 7/2014 | Zhou et al. | 435/287.2 |
| 8,891,949 | B2 * | 11/2014 | Hong et al. | 392/471 |
| 2004/0043479 | A1 * | 3/2004 | Briscoe et al. | 435/288.5 |
| 2004/0226620 | A1 * | 11/2004 | Therriault et al. | 137/825 |
| 2010/0089529 | A1 * | 4/2010 | Barholm-Hansen et al. | 156/247 |
| 2012/0097272 | A1 * | 4/2012 | Vulto et al. | 137/561 R |
| 2014/0014192 | A1 * | 1/2014 | Ussing | 137/13 |
| 2014/0332098 | A1 * | 11/2014 | Juncker et al. | 137/511 |
| 2015/0056717 | A1 * | 2/2015 | Zamir et al. | 436/180 |

OTHER PUBLICATIONS

Juncker, David et al., "Autonomous Microfluidic Capillary System", Anal. Chem., vol. 74, No. 24, Dec. 15, 2002, pp. 6139-6144.

Zimmermann, M. et al., "Valves for Autonomous Capillary Systems", Microfluid Nanfluid, vol. 5, No. 3, Jan. 8, 2008, pp. 395-402.

* cited by examiner

MICROSTRUCTURED MICROPILLAR ARRAYS FOR CONTROLLABLE FILLING OF A CAPILLARY PUMP

CROSS-REFERENCE TO RELATED APPLICATION

This application claims priority to European Patent Application No. 14151290. 5 filed on Jan. 15, 2014, the contents of which are hereby incorporated by reference

TECHNICAL FIELD

The disclosure is related to the field of capillary micro-fluidic devices. In particular, the present disclosure relates to the field of passive pumping of fluids.

BACKGROUND OF THE DISCLOSURE

Typically, micro-fluidic capillary systems necessitate the use of capillary pumps. The capillary pumps have posts to create a capillary pressure inside the capillary system. An effective and efficient micro-fluidic capillary pumping system requires a high capillary pressure with a low-flow resistance. The dimensions of the posts of the capillary pump should be kept relatively small to create a high capillary pressure with a low flow resistance of the fluid.

In a capillary pumping application, the capillary pressure may be represented by $\Delta P_{cap}=2\gamma/R$, wherein $\gamma$ is the liquid-vapor surface tension and R is the radius of curvature of the liquid-vapor interface. The radius of curvature 'R' is dependent on the geometry of the hydrophilic posts of the capillary pump. Therefore, the dimensions of the channel are kept small to provide a large capillary pressure. However, smaller channel dimensions result in the creation of viscous forces that result in an increase of the flow resistance of the fluid through the channel. Therefore, there is a trade-off between high capillary pressure and low flow resistance of a fluid.

Several solutions are suggested for overcoming the aforementioned drawbacks. One of the solutions is to use a plurality of parallel channels to reduce the flow resistance while maintaining a high capillary pressure. Another solution is to use a micro-pillar array. Both the aforementioned solutions may provide a high capillary pressure and a low flow resistance.

However, these solutions do not provide a reliable regular and controlled filling of the capillary pump. An irregular and uncontrolled filling of the capillary pump results in the creation of shortcut paths of a liquid in the capillary pump, whereby the fluid finds a direct path between an inlet and an outlet of the pump, without completely filling the pump. Further, the irregular and uncontrolled filling of the capillary pump results in the creation of air bubbles in a closed loop capillary pump resulting in a decrease of the volume of the capillary pump.

Hence, there is a desire for a capillary pump with a reliable controlled filling mechanism whilst achieving a high capillary pressure and a low flow resistance of a fluid sample in the pump. Further, there is a desire for a capillary pump with a reliable controlled filling mechanism to guide a fluid sample along a desired propagation path.

The abovementioned shortcomings, disadvantages, and/or problems are addressed herein and which will be understood by reading and studying the following description.

SUMMARY OF THE DISCLOSURE

Various embodiments of the present disclosure relate to a micro-fluidic device comprising a substrate, a cavity in the substrate, and a plurality of micro-pillar columns located inside the cavity. The micro-pillars columns are configured to create a capillary action when a fluid sample is provided in the cavity. Each micro-pillar column includes a plurality of micro-pillars. A micro-fluidic channel is present between two walls of any two adjacent micro-pillars in a same micro-pillar column. Each of the two walls comprises a sharp corner along the direction of a propagation path of the fluid sample in the micro-fluidic channel thereby forming a capillary stop valve.

According to one embodiment of the present disclosure, each micro-pillar column comprises a notch located in a sidewall of the cavity. The notch is provided adjacent to a micro-pillar located at one edge of each micro-pillar column. The notch together with a micro-pillar located at that edge of each micro-pillar column, functions as a capillary stop valve. Each notch of each adjacent micro-pillar column is located in an opposite sidewall of the cavity.

According to one embodiment of the present disclosure, the capillary stop valve pins a liquid-vapor interface to prevent the propagation path of the fluid sample along an undesired direction.

According to one embodiment of the present disclosure, each of the plurality of micro-pillars comprises smooth or round edges guiding the fluid sample along the desired propagation path. The smooth or round edge of a micro-pillar may be a 90 degree angle with a rounded corner. A micro-pillar located at an edge of a micro-pillar column has curved surfaces to guide the propagation path of the fluid sample from one micro-pillar column to another micro-pillar column in a column wise filling pattern or from one row to another row in a row wise filling pattern. The curved surfaces of a micro-pillar located at an edge of a micro-pillar column may be adapted to facilitate a fluid sample to propagate from one micro-pillar column to an adjacent micro-pillar column. The curved surfaces of a micro-pillar may be a 180 degree curve. A micro-pillar located at an edge of a micro-pillar column has at least one sharp corner.

According to one embodiment of the present disclosure, the substrate is a silicon substrate and the plurality of micro-pillars is fabricated from silicon. According to an embodiment of the disclosure, the micro-fluidic device is fabricated from a single piece of silicon.

According to one embodiment of the present disclosure, the plurality of micro-pillar columns are arranged to define a serpentine propagation path of the fluid sample in the micro-fluidic device.

According to one embodiment of the present disclosure, the angle $\beta$ of the sharp corner is larger than 90 degrees. In one example, the angle $\beta$ of the sharp corner is larger than $$\left(\frac{\pi}{2}-\theta\right),$$

wherein $\theta$ is defined as the contact angle of a fluid sample with the micro-fluidic channel.

These and other aspects of the embodiments of the present disclosure will be better appreciated and understood when considered in conjunction with the following description and the accompanying drawings. It should be understood, however, that the following description, while indicating example embodiments and numerous specific details thereof, are given by way of illustration and not by way of limitation. Many changes and modifications may be made within the scope of the embodiments of the present disclosure without departing from the spirit of the disclosure, and the embodiments of the present disclosure include all such modifications.

Figure 1:
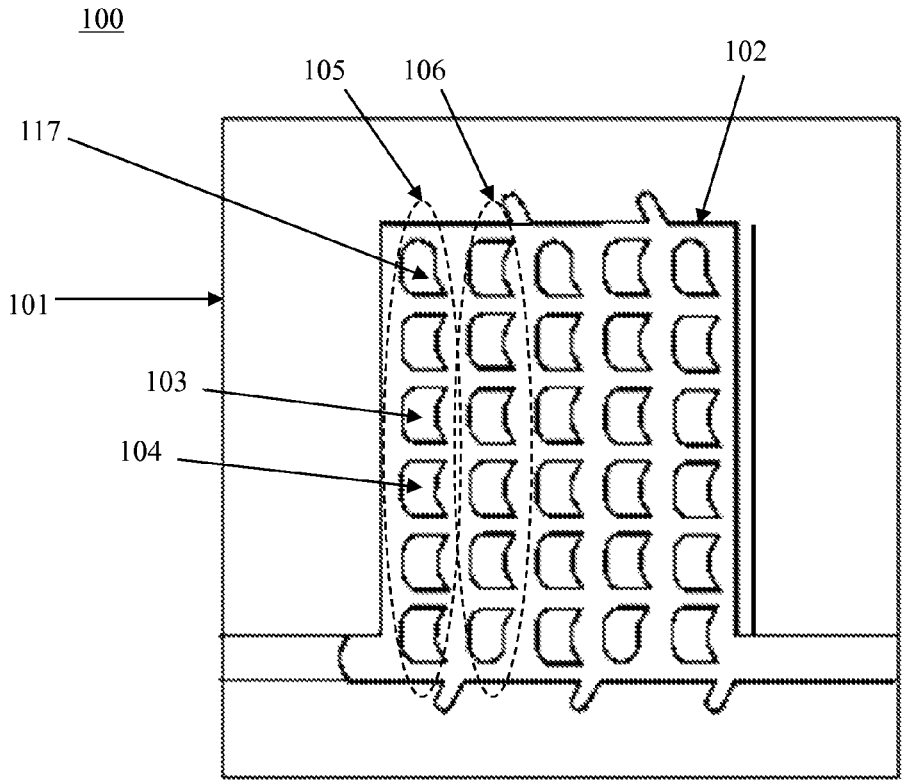
FIG. 1 illustrates a top view of a micro-fluidic device.

Although the specific features of the embodiments herein are shown in some drawings and not in others, this has been done for convenience only as each feature of the disclosure may be combined with any or all of the other features in accordance with the embodiments herein.

DETAILED DESCRIPTION

Embodiments of the present disclosure may provide a capillary pump with a controlled filling mechanism while achieving a high capillary pressure and a low flow resistance of a fluid sample in the pump.

Embodiments of the present disclosure may provide a capillary pump with a controlled filling mechanism to obtain a desired filling front in the pump.

Embodiments of the present disclosure may provide a capillary pump with a controlled filling mechanism to regulate a fluid sample flow along a desired fluid propagation path in the pump.

Embodiments of the present disclosure may provide a capillary pump with a controlled filling mechanism to obtain a column by column filling of the pump.

Embodiments of the present disclosure may provide a capillary pump with a controlled filling mechanism to obtain a row by row filling of the pump.

Embodiments of the present disclosure may provide a capillary pump with a controlled filling mechanism to obtain a desired filling pattern such as a serpentine propagation path of the fluid in the pump.

Embodiments of the present disclosure may provide a capillary pump with a controlled filling mechanism for use in a micro-fluidics based micro system for life science applications.

Embodiments of the present disclosure may provide a capillary pump with a controlled filling mechanism to form liquid bridges to achieve a desired fluid propagation path of the fluid sample in the pump.

Embodiments of the present disclosure may provide a micro-fluidic device that prevents a liquid-vapor (fluid) propagation in undesirable directions.

Embodiments of the present disclosure may provide a micro-fluidic device that may be easily fabricated using semiconductor fabrication techniques such as photolithography and deep reactive ion etching processes, e.g. CMOS compatible processing techniques.

Embodiments of the present disclosure may provide a capillary pump with microstructures to achieve a controllable filling of the pump.

Embodiments of the present disclosure may provide a capillary pump with micro-structures that are arranged and adapted to define the propagation path of a fluid sample in the pump.

In the following detailed description, reference is made to the accompanying drawings which illustrate specific embodiments. These embodiments are described in sufficient detail to enable those skilled in the art to practice the embodiments and it is to be understood that logical, mechanical and other changes may be made without departing from the scope of the embodiments. The following detailed description is therefore not to be taken in a limiting sense. The various embodiments of the present disclosure relate to a micro-fluidic device 100 comprising a substrate 101, a cavity 102 in the substrate and a plurality of micro-pillar columns 105, 106 located inside the cavity 102. The micro-pillar columns 105, 106 are configured to create a capillary action when a fluid sample is provided in the cavity 102. A micro-fluidic channel 107 is present between two walls 108, 109 of any two adjacent micro-pillars 103, 104 in a same micro-pillar column. Each of the two walls comprises a sharp corner along the direction of a propagation path of the fluid sample in the micro-fluidic channel 107 thereby forming a capillary stop valve.

According to one embodiment of the present disclosure, one or more notches 113, 114 is located in a sidewall 111, 112 of the cavity 102. The notch 113, 114 is provided adjacent to a micro-pillar 115, 116 located at one edge of each micro-pillar column 105, 106. The notch 113, 114 together with a micro-pillar 115, 116 located at that edge of each micro-pillar column 105, 106 functions as a capillary stop valve. The notch 113, 114 of each adjacent micro-pillar column is located in an opposite sidewall 111, 112 of the cavity 102.

According to one embodiment of the present disclosure, the capillary stop valve pins a liquid-vapor interface to prevent the propagation path of the fluid sample along an undesired direction, e.g. in between two micro-pillars 103, 104 of a micro-pillar column.

According to one embodiment of the present disclosure, each of the plurality of micro-pillars 103, 104 comprises smooth or round edges for guiding the propagation path of the fluid sample along a desired direction. A micro-pillar 117 located at one edge of a micro-pillar column 105 has curved surfaces to guide the propagation path of the fluid sample from one micro-pillar column 105 to another micro-pillar column 106 in a column wise filling pattern or from one row to another row in a row wise filling pattern.

According to one embodiment of the present disclosure, the substrate 101 is a silicon substrate and the plurality of micro-pillars 103, 104 is fabricated from silicon. It may be advantageous to use silicon rather than more common microfluidic materials such as glass or polymers since the very high anisotropic etching of silicon results in fine structures with extremely high aspect ratios. The silicon micro-pillars typically have lateral dimensions ranging from 1 μm to 20 μm with aspect ratios ranging between 20 to 50. In one example, the high aspect ratios are advantageous in having a high surface to volume ratio, essential for a capillary flow. Moreover, silicon is an inert material with clear advantages towards an implementation of biochemical reactions.

According to one embodiment of the present disclosure, the plurality of micro-pillar columns 105, 106 are arranged and adapted to allow a serpentine propagation path of the fluid sample through the cavity 102.

Figures 2A, 2B:
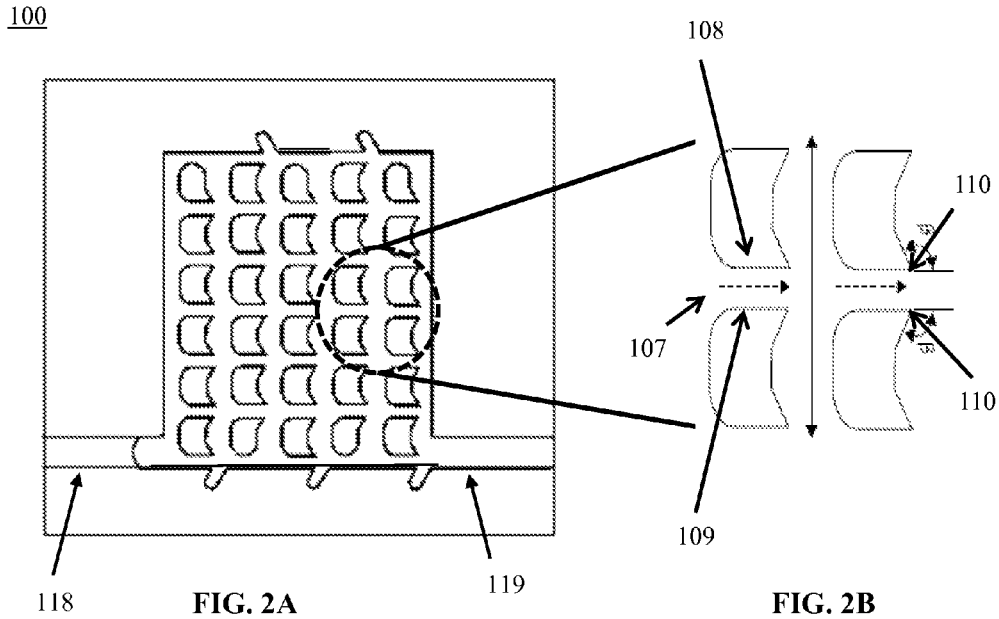
FIG. 2A illustrates a top view of a micro-fluidic device, indicating a number of micro-pillars arranged in columns in a cavity of the micro-fluidic device.
FIG. 2B illustrates an enlarged top view of four micro-pillars of a micro-fluidic device.
Figure 2C:
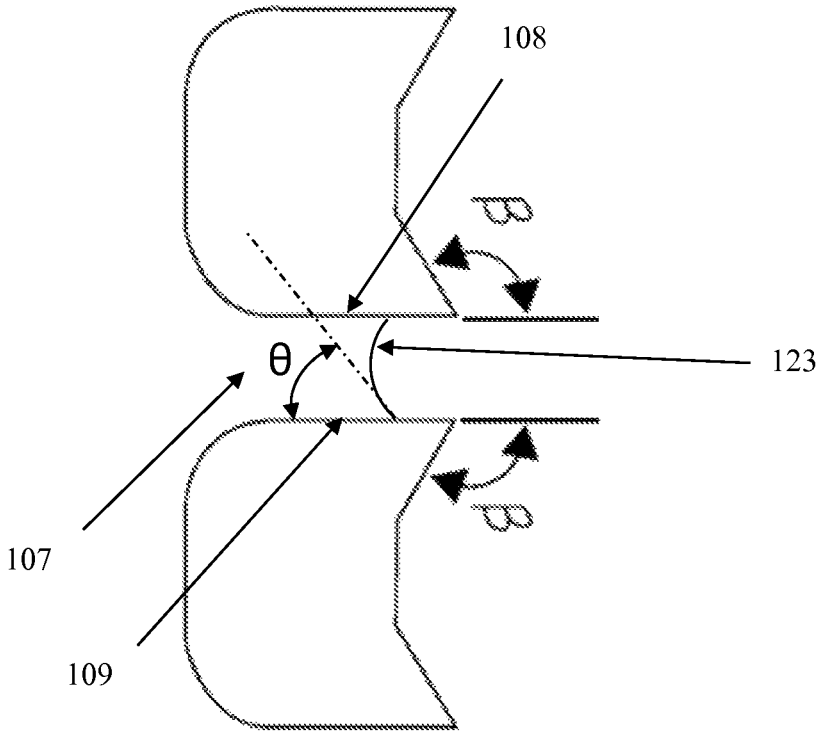
FIG. 2C illustrates an enlarged top view of two micro-pillars of a micro-fluidic device.

According to one embodiment of the present disclosure, the angle β of the sharp corner is larger than 90 degrees. The angle β of the sharp corner is larger than $$\left(\frac{\pi}{2}-\theta\right),$$

wherein θ is defined as the contact angle of a fluid sample with the micro-fluidic channel. Angle β and angle θ are illustrated in FIG. 2B and FIG. 2C respectively.

One embodiment of the present disclosure discloses a micro-fluidic device 100 used for a passive pumping of fluids. The micro-fluidic device 100 of the present disclosure provides a high capillary pressure and a low flow resistance. The micro-fluidic device 100 of the present disclosure helps to eliminate the creation of air bubbles and also helps to eliminate a possible shortcut of the propagation path of a fluid sample in the micro-fluidic device. Thus, the micro-fluidic device 100 can be filled completely. As a potential advantage, the complete volume of the micro-fluidic device 100 can be used.

The micro-fluidic device 100 comprises a plurality of micro-pillar columns 105, 106 to control a propagation path of the fluid sample. Each micro-pillar column 105, 106 comprises a plurality of micro-pillars 103, 104. All the micro-pillars 103, 104 are provided with a feature such as at least one sharp corner 110 which is used to pin the fluid sample thereby preventing the propagation of the fluid sample in undesired directions. For example, a micro-fluidic channel 107 formed in between the two adjacent micro-pillars 103,104 in a same micro-pillar column may function as a capillary stop valve which pins a fluid sample propagating through the micro-fluidic channel 107. The micro-pillars 103,104 in a micro-pillar column 105 are spaced from each other thereby allowing the micro-fluidic channel between the adjacent micro-pillars 103,104 and the sharp edges of both micro-pillars to function as a capillary stop valve. The micro-fluidic channel 107 present in between two micro-pillars 103, 104 is formed by a wall 108, 109 of each micro-pillar. Each wall 108, 109 may comprise a sharp corner 110 pointing towards the direction of the propagation path of the fluid sample through the micro-fluidic channel 107.

A plurality of micro-pillars 103, 104 comprises smooth, rounded edges which guide the fluid sample in a desired propagation path. A plurality of parallel flow paths is created between micro-pillar columns 105, 106 or, between the sidewalls 108, 109 and the micro-pillar columns 105, 106. All the micro-pillars 103, 104 of the micro-fluidic device 100 may be positioned as a grid pattern in the cavity 102. The sidewalls of the cavity 102 of the micro-fluidic device 100 may be aligned with the grid pattern of the micro-pillars 103, 104. All micro-pillar columns may be positioned parallel to the sidewalls of the cavity. The plurality of flow paths provides a low flow resistance. Further, the micro-pillars 103,104 are spaced in such a way that the micro-pillars 103, 104 provide a high capillary pressure.

Figure 5:
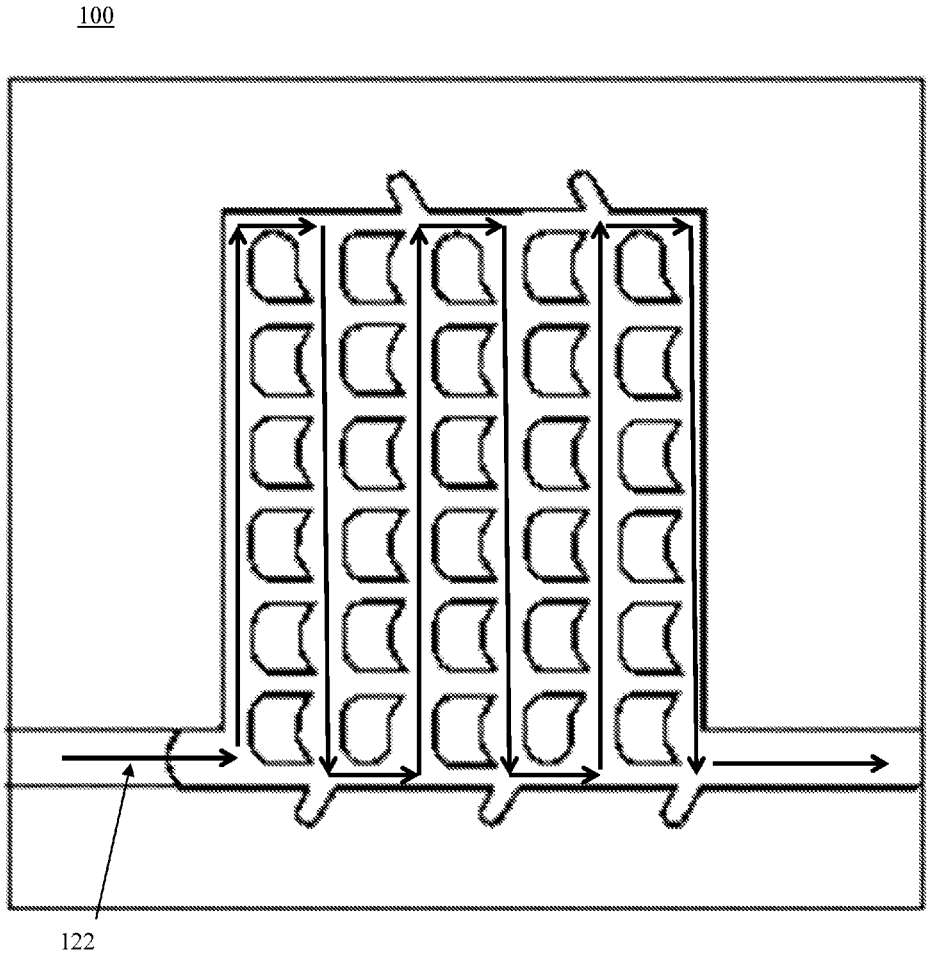
FIG. 5 illustrates a propagation path of a fluid sample in the micro-fluidic device.

FIG. 1 illustrates a top view of a micro-fluidic device of an embodiment of the present disclosure. With respect to FIG. 1, the micro-fluidic device 100 comprises a substrate 101. The substrate 101 may be a silicon substrate. A cavity 102 is present in the substrate 101. The cavity 102 may be fabricated in the substrate 101 using a semiconductor fabrication technique, e.g. CMOS compatible processing techniques such as dry etch. A plurality of micro-pillars 103, 104 is positioned on a bottom surface of the cavity 102. The plurality of micro-pillars 103, 104 may be grouped in different micro-pillar columns wherein each micro-pillar column is parallel to another micro-pillar column and parallel to the sidewalls of the cavity. The plurality of micro-pillars 103, 104 may be fabricated from silicon using a semiconductor fabrication technique, e.g. a CMOS compatible processing technique. The plurality of micro-pillar columns 105, 106 is positioned and arranged to allow a serpentine propagation path of the fluid sample through the cavity as illustrated in FIG. 5.

With respect to FIG. 1, the micro-fluidic device 100 comprises a plurality of micro-pillar columns 105, 106 arranged in the form of a grid in the cavity 102. A micro-fluidic channel is formed between two walls of any two adjacent micro-pillars 103, 104 in the same micro-pillar column 105. Each of the two walls comprises a sharp corner along the direction of a propagation path of the fluid sample in the micro-fluidic channel thereby forming a capillary stop valve. The sharp corner of each wall points into the direction of the propagation path of the fluid sample in the micro-fluidic channel. The capillary stop valve pins a liquid-vapor interface to prevent the propagation of the fluid sample along an undesired direction. Each of the plurality of micro-pillars 103, 104 comprises smooth or round edges for guiding the propagation path of the fluid sample along a desired direction. Each of the plurality of micro-pillars 103, 104 comprises at least one sharp edge.

The micro pillar 117 located at one edge of a micro pillar column 105 has curved surfaces to guide the propagation path of the fluid sample from one micro-pillar column 105 to another micro-pillar column 106 in a column wise filling pattern or from one row to another row in a row wise filling pattern. Each micro-pillar column 105 may contain one micro-pillar 117 with one sharp corner wherein the micro-pillar 117 may be positioned at an edge of the micro-pillar column 105. The micro-pillar 117 may be positioned at opposite ends for adjacent micro-pillar columns 105, 106.

Adjacent micro-pillar columns 105, 106 are arranged to provide a capillary action when a fluid sample is introduced into the cavity 102, through an inlet 118 (as shown in FIG. 2A). The plurality of micro-pillars in the cavity 102 of the substrate 101 are positioned and adapted to provide a capillary action when a fluid sample is introduced in the cavity 102.

FIG. 2A illustrates a top view of a micro-fluidic device 100 with a cavity and a plurality of micro-pillars inside the cavity. The cavity comprises an inlet 118 and an outlet 119. FIG. 2B is an enlarged view of a part of FIG. 2A. FIG. 2B illustrates four micro-pillars of the micro-fluidic device 100; two adjacent micro-pillars of one micro-pillar column and two adjacent micro-pillars of an adjacent micro-pillar column. A micro-fluidic channel 107 is formed between the two walls 108, 109 of any two adjacent micro-pillars in a same micro-pillar column. Each of the two walls 108, 109 comprises a sharp corner 110 along the direction of a propagation path of the fluid sample in the micro-fluidic channel 107. The two walls 108, 109 form a capillary stop valve. The propagation of a fluid sample in the micro-fluidic channel 107 is stopped, when the fluid sample encounters the sharp corners of both walls 108,109. The capillary stop valve pins a liquid-vapor interface to prevent a propagation of the fluid sample in an undesired direction. Each of the plurality of micro-pillars comprises smoothed round edges for guiding the propagation path of the fluid sample along a desired direction.

The sharp corner 110 has an angle β which is larger than 90 degrees. The angle β of the sharp corner may be larger than $$\left(\frac{\pi}{2}-\theta\right),$$

wherein θ is defined as the contact angle of a fluid sample 123 with a wall 108, 109 of the micro-fluidic channel 107, as illustrated in FIG. 2C. The sharp corner 110 of each of the walls 108, 109 pins the fluid sample interface thereby preventing the propagation of the fluid sample in undesirable directions, e.g. in between micro-pillars of the same micro-pillar column. The sharp corner 110 of each of the walls 108, 109 stop the propagation of the fluid sample in between the walls 108, 109. The walls 108, 109 act as a capillary stop valve.

Figure 3:
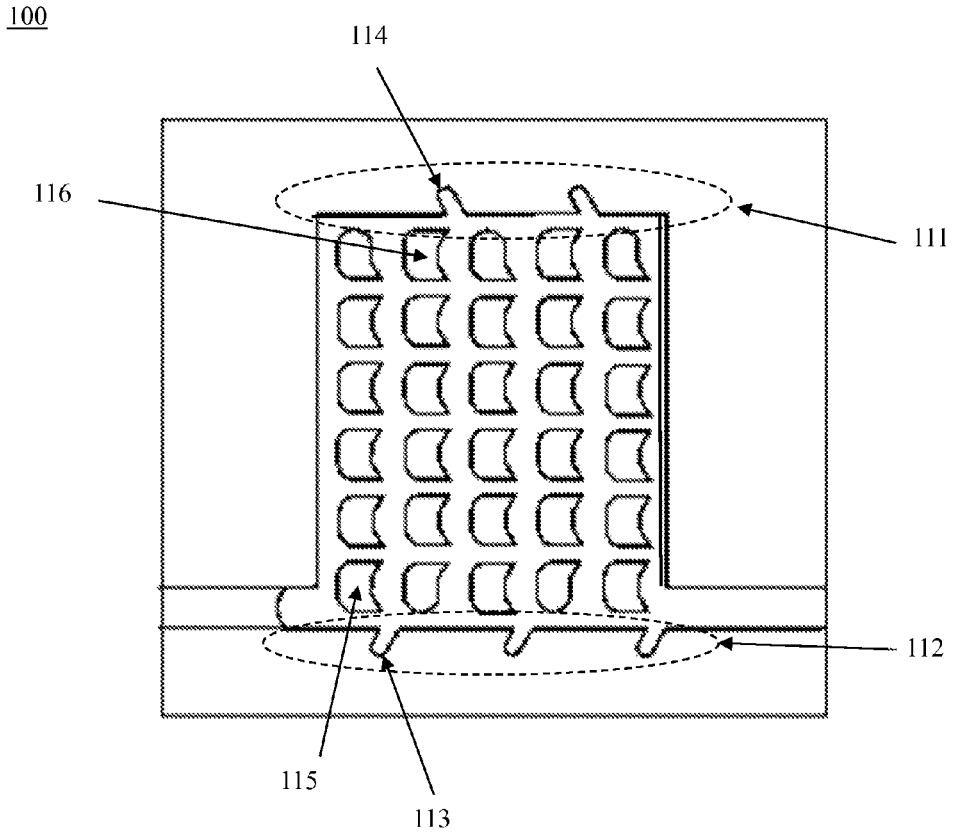
FIG. 3 illustrates a top view of a micro-fluidic device with notches in sidewalls of a cavity.

FIG. 3 illustrates a top view of a micro-fluidic device 100 comprising a cavity with an inlet and an outlet, micro-pillars positioned inside the cavity, and notches present in the side-walls of the cavity. The micro-fluidic device 100 comprises two side walls 111, 112. The side walls 111, 112 feature a plurality of notches 114, 113. The notches 114, 113 are provided at pre-determined locations in each of the sidewalls 111, 112. The notches 113, 114 are positioned adjacent to the micro-pillars 115, 116 respectively. The micro-pillars 115, 116 comprise sharp corners 110 (as shown in FIG. 2B). Each notch 113, 114 is associated with one micro-pillar to create a capillary stop valve thereby stopping the flow of the fluid sample in between the notch and its associated micro-pillar. Each notch 113, 114 is associated with one micro-pillar located at an edge of a micro-pillar column.

An embodiment of the present disclosure relates to the use of the notches 113, 114 in conjunction with the micro pillars 115, 116 to stop the flow of the fluid sample. For example, the notch 113 together with the micro-pillar 115 functions as a capillary stop valve. The sharp corner of the notch 113 in combination with the sharp corner of the micro-pillar 115 creates a capillary stop valve. The distance between the notch 113 and the micro-pillar 115 is adapted to allow the notch 113 and the micro-pillar 115 to function as a capillary stop valve. Hence, the propagation of a fluid sample in between the notch 113 and the micro-pillar 115 is stopped. As a potential advantage, different notches associated with different micro-pillars are used to direct the flow of the fluid sample in pre-determined directions, e.g. a serpentine propagation path as illustrated in FIG. 5.

FIGS. 4A-4D illustrate the propagation path of a fluid sample through the micro-fluidic device 100, indicating a column wise filling of the micro-fluidic device with the fluid sample.

Figure 4A:
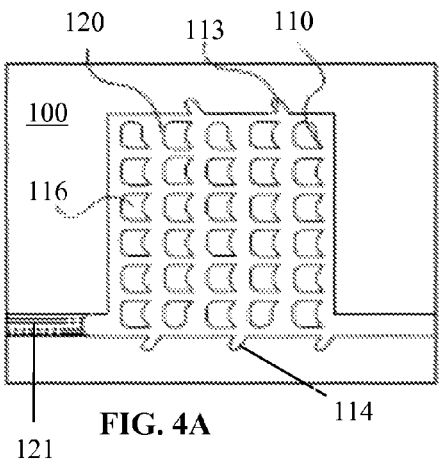
FIGS. 4A-4D illustrate a propagation of a fluid through a micro-fluidic device indicating a column wise filling of fluid.

With respect to FIG. 4A-4D, the micro-fluidic device 100 is filled with a fluid sample in a column wise fashion (column by column). As shown in FIG. 4A, the fluid sample 121 enters the cavity (102 as shown in FIG. 1) through an inlet. The micro-pillars 120 and 116 are provided with sharp corners 110. The notches 113 and 114 are provided on opposite side walls of the cavity. The curved smooth edges of the micro-pillars 115 and 116 enable a smooth flow of the fluid sample in between micro-pillar columns or in between a micro-pillar column and a sidewall of the cavity.

Figure 4B:
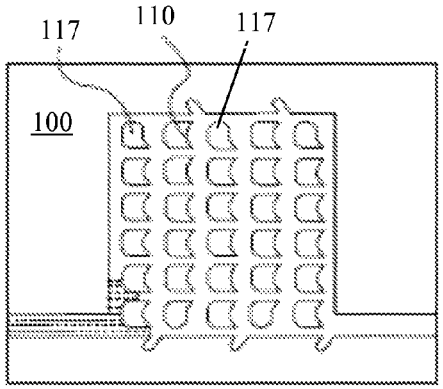
Figure 4C:
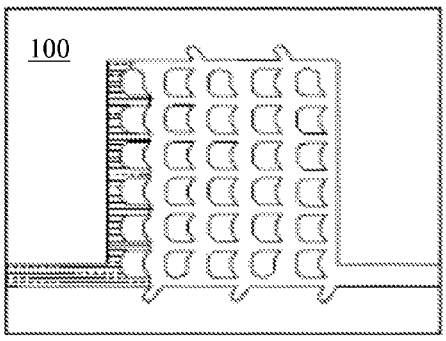
Figure 4D:
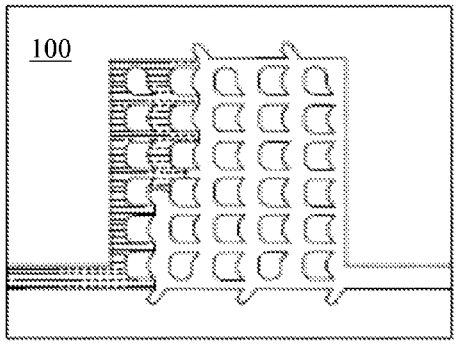

As shown in FIG. 4B, the micro pillars 117 positioned at the edges of a micro pillar column comprise curved surfaces configured to guide the fluid sample from one micro pillar column to another micro pillar column. FIG. 4C and FIG. 4D further illustrate the filling pattern of the fluid sample in the micro-fluidic device 100. As illustrated in FIG. 4C and FIG. 4D, the filling pattern of the fluid sample in the micro-fluidic device 100 is a zigzag filling pattern thereby filling the micro-fluidic device 100 column per column. As a potential advantage, a controlled/regulated filling of the complete micro-fluidic device can be achieved.

FIG. 5 illustrates a propagation path 122 of a fluid sample through the micro-fluidic device 100. The propagation path of the sample fluid is shown using the arrows. As shown in FIG. 5 the sample fluid fills the micro-fluidic device 100 in a column-by-column fashion.

The micro-fluidic device 100 as presented in this disclosure offers a low flow resistance combined with a high capillary pressure. The micro-fluidic device 100 and its features provide a regular and controlled flow of a fluid sample in the micro-fluidic device 100. Columns of micro-structured micro-pillars are used to guide a fluid sample in a pre-determined direction in the micro-fluidic device. Each micro-structured pillar comprises at least one sharp corner to pin a liquid-vapor interface thereby preventing the flow/propagation of the fluid in undesirable directions. The micro-fluidic device 100 eliminates the creation of air bubbles in the device as the propagation path is fixed by the configuration of the different micro-pillar columns. As a potential advantage, the volume of the micro-fluidic device is not reduced. The micro-fluidic device 100 prevents a direct, unhindered flow of the fluid sample from the inlet 118 to the outlet 119, thereby preventing the creation of fluid shortcuts in the micro-fluidic device 100. This way, the complete volume of the micro-fluidic device 100 may be used. The micro-fluidic device 100 of the present disclosure may be fabricated using semiconductor fabrication techniques. As a potential advantage, the cost of the device may be reduced. The use of semiconductor fabrication techniques allows the device to be fabricated completely in silicon. This way, micro-structures with high aspect ratios may be fabricated inside the device. This is advantageous for creating a strong capillary action in the micro-fluidic device.

The foregoing description of the embodiments will so fully reveal the general nature of the embodiments herein that others can, by applying current knowledge, readily modify and/or adapt for various applications such specific embodiments without departing from the disclosed concept and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of example embodiments, those skilled in the art will recognize that the embodiments herein can be practiced with modification within the spirit and scope of the appended claims.

Although the embodiments of the present disclosure are described with various specific embodiments, it will be apparent for a person skilled in the art to practice the disclosure with modifications. However, all such modifications are deemed to be within the scope of the claims. It is also to be understood that the following claims are intended to cover all of the general and specific features of the embodiments described herein and all the statements of the scope of the embodiments which as a matter of language might be said to fall there between.

We claim:

1. A micro-fluidic device comprising:

a substrate;

a cavity in the substrate; and a plurality of micro-pillar columns located in the cavity;

wherein the plurality of micro-pillar columns is configured to create a capillary action when a fluid sample is provided in the cavity, wherein a micro-fluidic channel is present between two walls of any two adjacent micro-pillars in a same micro-pillar column, wherein each of the two walls comprises a sharp corner along a direction of a propagation path of the fluid sample in the micro-fluidic channel thereby forming a first capillary stop valve, and wherein each micro-pillar column includes a notch located in a sidewall of the cavity, wherein the notch is provided adjacent to a micro-pillar located at one edge of each micro-pillar column, wherein the notch in conjunction with the micro-pillar located at that one edge of each micro-pillar column functions as a second capillary stop valve, and wherein each notch of each adjacent micro-pillar column is located in an opposite sidewall of the cavity.

2. The micro-fluidic device according to claim 1, wherein the capillary stop valve pins a liquid-vapor interface to prevent the propagation path of the fluid sample along an undesired direction.

3. The micro-fluidic device according to claim 1, wherein each of the plurality of micro-pillars comprises smoothed round edges for guiding the propagation path of the fluid sample along a desired direction.

4. The micro-fluidic device according to claim 1, wherein a micro pillar located at one edge of a micro pillar column has curved surfaces to guide the propagation path of the fluid sample from one micro-pillar column to another micro-pillar column in a column wise filling pattern or from one row to another row in a row wise filling pattern.

5. The micro-fluidic device according to claim 1, wherein the substrate is a silicon substrate, and wherein the plurality of micro-pillars are fabricated from silicon.

6. The micro-fluidic device according to claim 1, wherein the plurality of micro-pillar columns is arranged to allow a serpentine propagation path of the fluid sample through the cavity.

7. The micro-fluidic device according to claim 1, wherein an angle $\beta$ of the sharp corner is larger than 90 degrees.

8. The micro-fluidic device according to claim 1, wherein an angle $\beta$ of the sharp corner is larger than $(\pi/2-\theta)$, wherein $\theta$ is defined as the contact angle of a fluid sample with the micro-fluidic channel.

* * * * *